US007621770B1

(12) United States Patent
Finizio et al.

(10) Patent No.: US 7,621,770 B1
(45) Date of Patent: Nov. 24, 2009

(54) LOW-PROFILE D-SUBSHELL CONNECTOR SYSTEM WITH INTERLOCKING COMPONENTS

(75) Inventors: Francesco Finizio, Mission Viejo, CA (US); Ton Do, Corona, CA (US)

(73) Assignee: Thales Avionics, Inc., Irvine, CA (US)

( * ) Notice: Subject to any disclaimer, the term of this patent is extended or adjusted under 35 U.S.C. 154(b) by 0 days.

(21) Appl. No.: 12/338,288

(22) Filed: Dec. 18, 2008

(51) Int. Cl.
*H01R 13/627* (2006.01)

(52) U.S. Cl. ..... 439/354

(58) Field of Classification Search ..... 439/352, 439/354

See application file for complete search history.

(56) References Cited

U.S. PATENT DOCUMENTS 4,261,628 A * 4/1981 Gallagher et al. ..... 439/95
6,273,761 B1 8/2001 Hsu et al.
7,540,756 B1 * 6/2009 Strahl ..... 439/354
2006/0094281 A1 * 5/2006 Dang ..... 439/352
2006/0148301 A1 * 7/2006 Kim ..... 439/354

* cited by examiner

*Primary Examiner*—Tho D Ta
(74) *Attorney, Agent, or Firm*—Drinker Biddle & Reath LLP

(57) ABSTRACT

A low-profile D-subshell connector system is provided with interlocking components that can be used where space limitations are required. The system comprises a connector plug that has a connector; a backshell that houses a portion of the connector and is affixed to the connector; and a latch that is affixed to the connector and backshell. The latch comprises an angled tab that is resiliently pivotally mounted to a front portion of the latch. The tab comprises a wide region, a narrow region, and a release protrusion extending perpendicular from a top surface of the tab. A catch assembly engages the tab of the latch, the catch comprising a front portion having a notch therein. A part of the catch front portion serves to engage the wide region of the tab, thereby forcing the tab to pivot when the connector is partially inserted; and the narrow region of the tab resides in the catch notch when the connector is fully inserted.

8 Claims, 5 Drawing Sheets

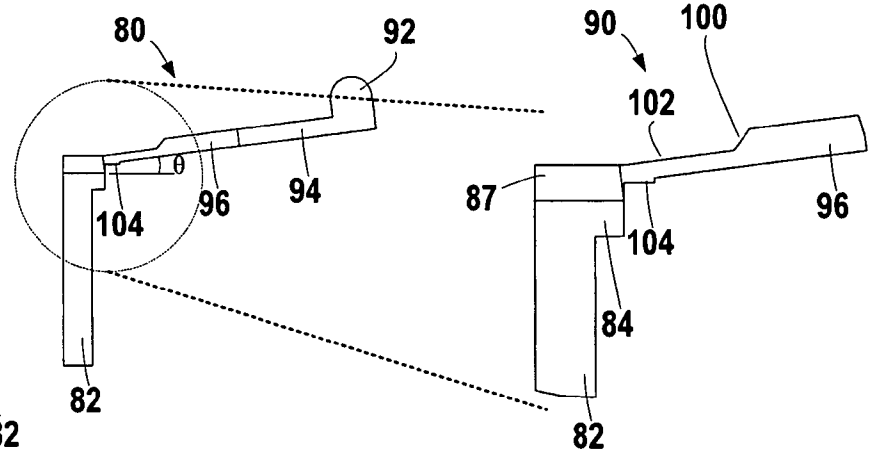
FIG. 3C
FIG. 3B
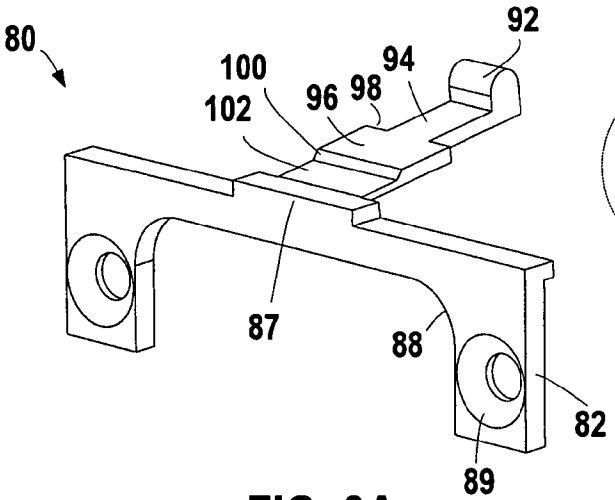
FIG. 3A
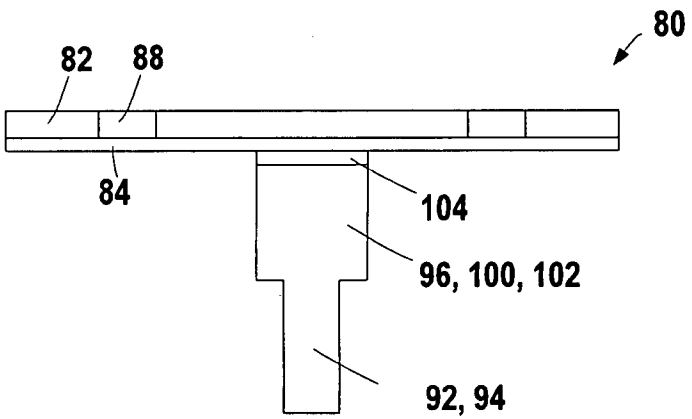
FIG. 3E
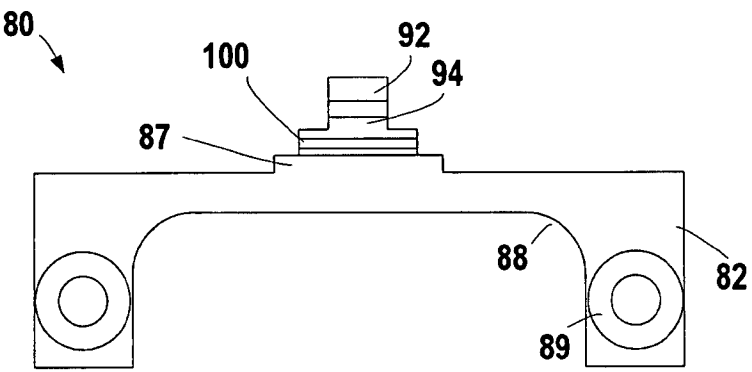
FIG. 3D

LOW-PROFILE D-SUBSHELL CONNECTOR SYSTEM WITH INTERLOCKING COMPONENTS

BACKGROUND

1. Field of the Invention

The present invention relates to a connector system with interlocking components and specifically to a low-profile D-subshell connector system with interlocking components.

2. Description of Related Art

Connectors that used some form of locking mechanism to ensure that the two halves of the connector remain joined to one another are known. In certain circumstances, however, space limitations have historically prevented the use of reliable locking mechanisms that are strong, efficient, yet easy to use. Although certain connector locking mechanisms utilizing some form of a resilient tab are known, such as the industry standard RJ-45 connector, this concept has never been applied in the context of a low-profile D-subshell connector. What is needed is a locking mechanism that can be used with a low-profile D-subshell connector that is inexpensive, easy to manufacture, reliable, strong, and easy to use.

SUMMARY

The present invention is directed to a low-profile D-subshell connector system with interlocking components that can be used where space limitations are required. Embodiments of the invention could be used, e.g., when mounting a video display unit (VDU) within a recess on an aircraft, where space is at a premium, and close fitting components are necessary for maximizing space.

Accordingly, a D-subshell connector system is provided, comprising: a connector plug, comprising: a connector; a backshell that houses a portion of the connector and is affixed to the connector; and a latch that is formed as a separate piece and is affixed to the connector and backshell, the latch comprising: an angled tab that is resiliently pivotally mounted to a front portion of the latch, the tab comprising a wide region adjacent to the pivot, a narrow region on a side of the wide region opposite the pivot, and a release protrusion extending perpendicular from a top surface of the tab at a distal end of the tab; and a cutout through which the connector extends; the connector system further comprising: a catch assembly, comprising: a body portion having a mounting surface; and a catch extending in a generally perpendicular direction from the front surface, the catch comprising a front portion having a notch therein; wherein: a part of the catch front portion serves to engage the wide region of the tab, thereby forcing the tab to pivot when the connector is partially inserted; and the narrow region of the tab resides in the catch notch when the connector is fully inserted.

BRIEF DESCRIPTION OF THE DRAWINGS

The accompanying drawings, which are incorporated herein and constitute part of this specification, illustrate exemplary embodiments of the invention, and together with the general description given above and the detailed description given below, serve to explain features of the invention.

FIGS. 3A-E are various views of the connector latch for the connector shown in FIG. 1;

DETAILED DESCRIPTION OF THE PREFERRED EMBODIMENTS

Figure 1:
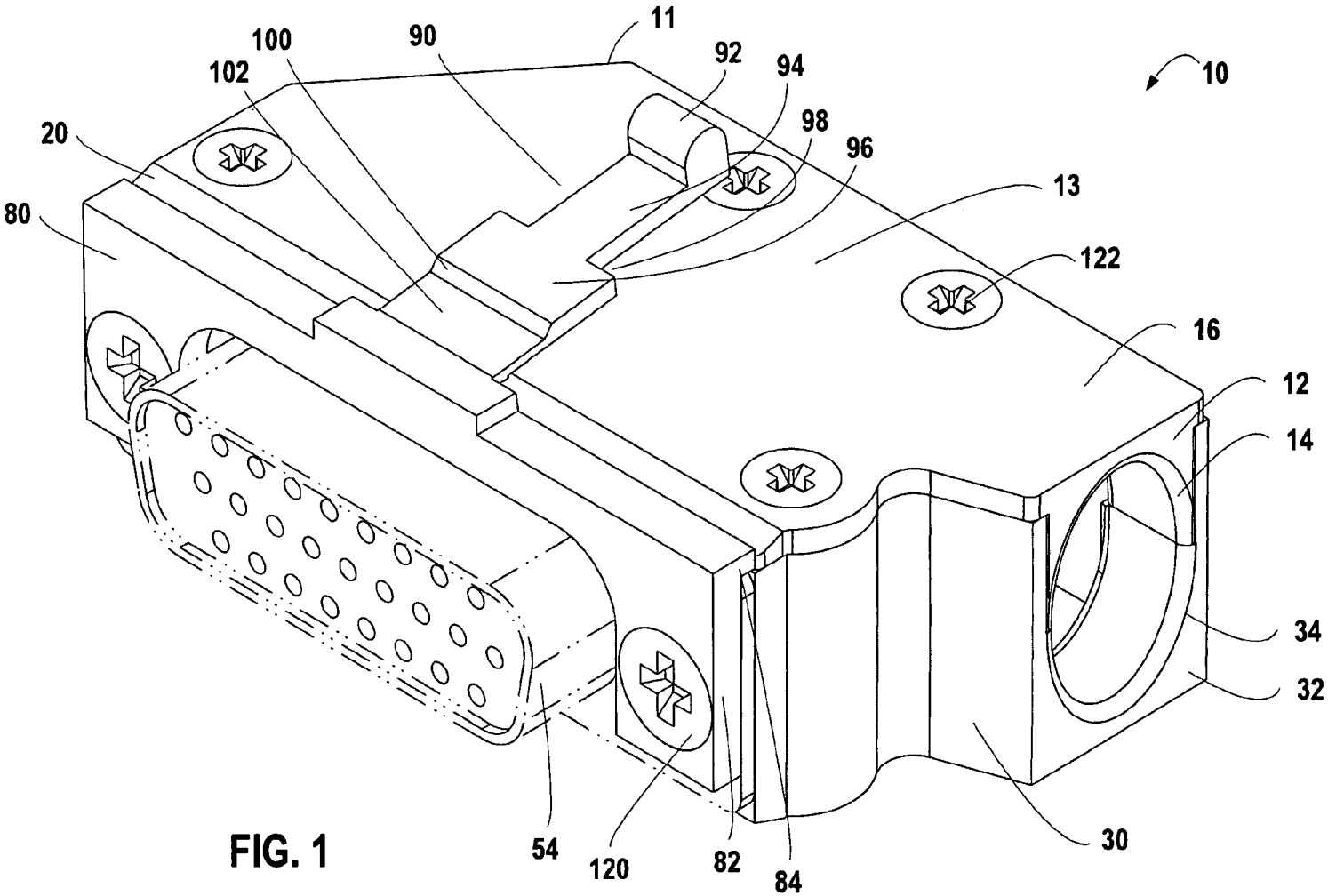
FIG. 1 is an isometric view of an exemplary low-profile D-subshell connector according to an embodiment of the invention.
Figure 4B:
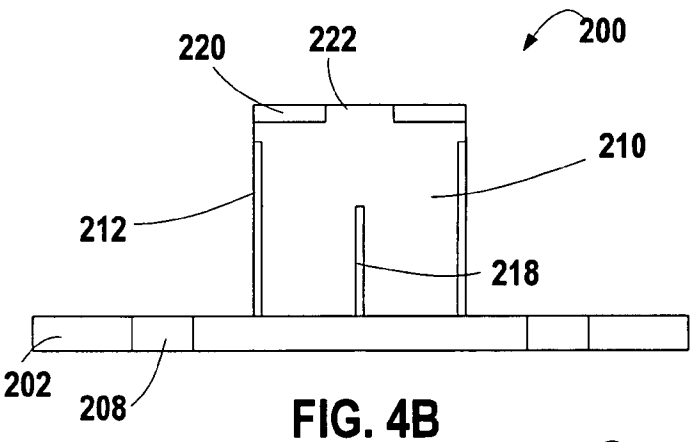
FIGS. 4A-4D are various views of a catch assembly that mates with the connector latch shown in FIGS. 3A-E.
Figure 4D:
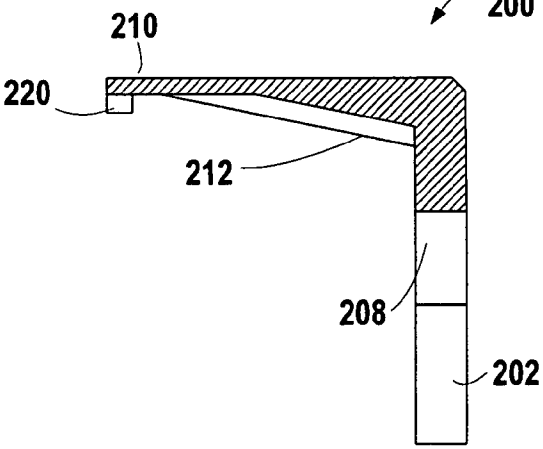
Figure 4A:
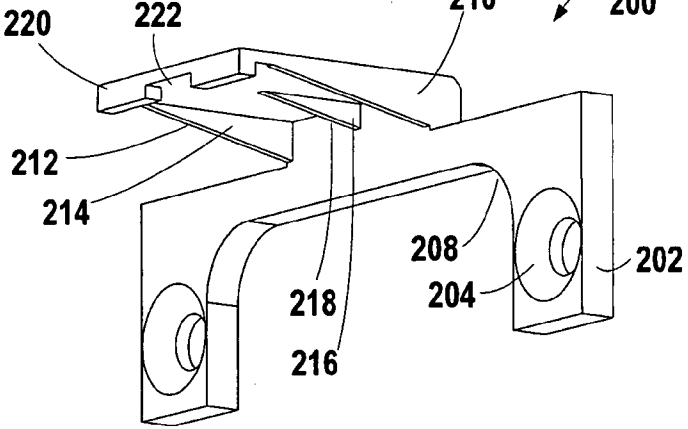
Figure 4C:
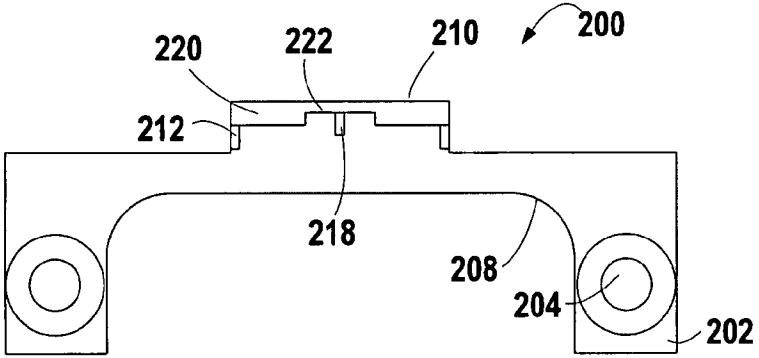
Figure 5:
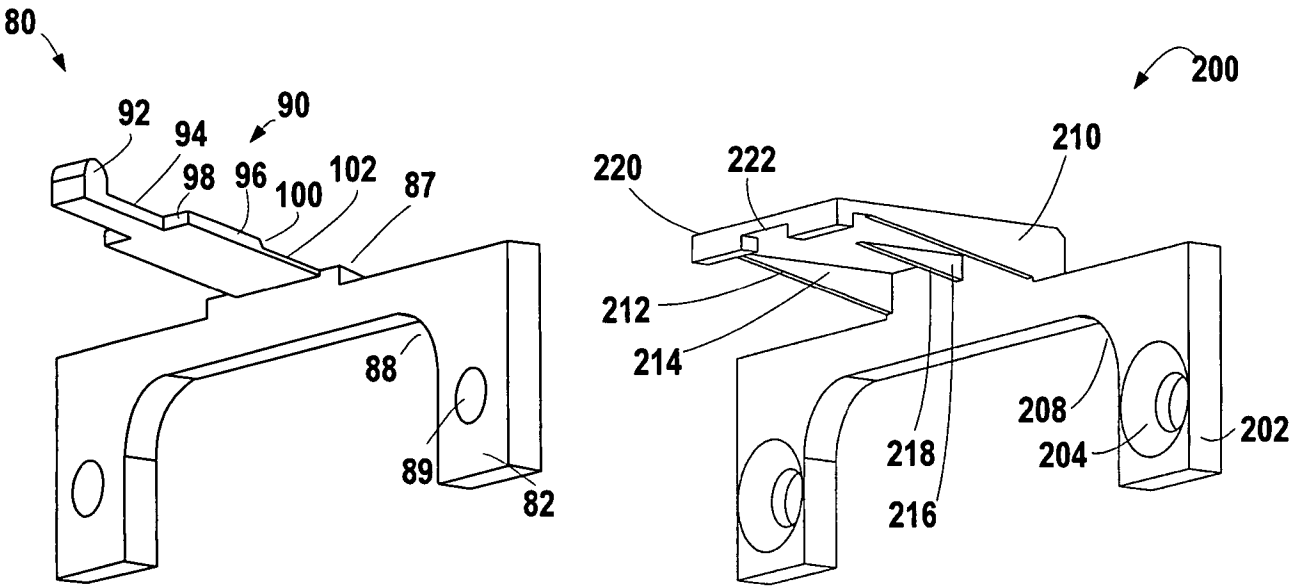
FIG. 5 is an isometric view illustrating how the elements of the latch and catch are interrelated.

FIGS. 1 (assembled view) and 2 (exploded view) illustrate an exemplary embodiment of the low-profile D-subshell connector 10. The connector 10 is broken down into several major components, including a backshell 11 comprising a top section 13 and bottom section 30, a connector section 50, and a latch 80 that is used to affix the connector 10 to a mating catch 200, 210 (FIGS. 4A-5).

In detail, the top section 13 and bottom section 30 are fastened together in order to make the connector backshell 11. These may be fastened together using screws 122 that extend through holes 18 in the top surface 16 and are received in threaded mounting holes 36 of the bottom section 30. However, the backshell sections 13, 30 could easily be joined via other mechanisms, such as snap fittings, etc.

The bottom section 30 comprises front portion 38 having a connector receiving area 42. In the exemplary embodiment, this receiving area 42 is U-shaped in order to receive a D-subshell connector 54. However, the invention is not so limited and could comprise any shaped connector, ranging from long and flat connectors to those that are round. The top section may have, e.g., an angled front edge portion 20.

The bottom section 30 also comprises a bottom portion 32 that contains a wire hole portion 34 that, when the bottom section 30 is joined with the top section 11, forms a hole in combination with the top section wire hole portion 14 through which a cable can be provided. In a preferred embodiment, and as illustrated in the drawings, the cable and connector are at right-angles with one another in order to help minimize the depth of the connector plug 10. In the embodiment shown in FIGS. 1 and 2, the 26-pin D-connector has dimensions of roughly 2" in width, 1" in depth, and 0.5" in height.

The backshell is preferably made of metal in order to enhance its shielding capability and enhance its durability, although plastic or other material could easily be used where cost is an issue.

The connector section 50 comprises the connector itself 54 and a flange 52 comprising a mounting hole 56 that permits the connector section 50 to be affixed to the backshell 11 via e.g., screws 120. A rear portion 58 of the connector 50 extends through the reception portion 42 of the bottom section 30. As noted previously, the 26-pin D-connector is illustrated in the drawings, but any form of connector could be utilized.

The latch 80 portions are defined as follows, although the functioning of the latch 80 elements will become more apparent when considered with respect to the catch 200 elements and functions, as illustrated in FIG. 5 and described in more detail below.

Figure 2:
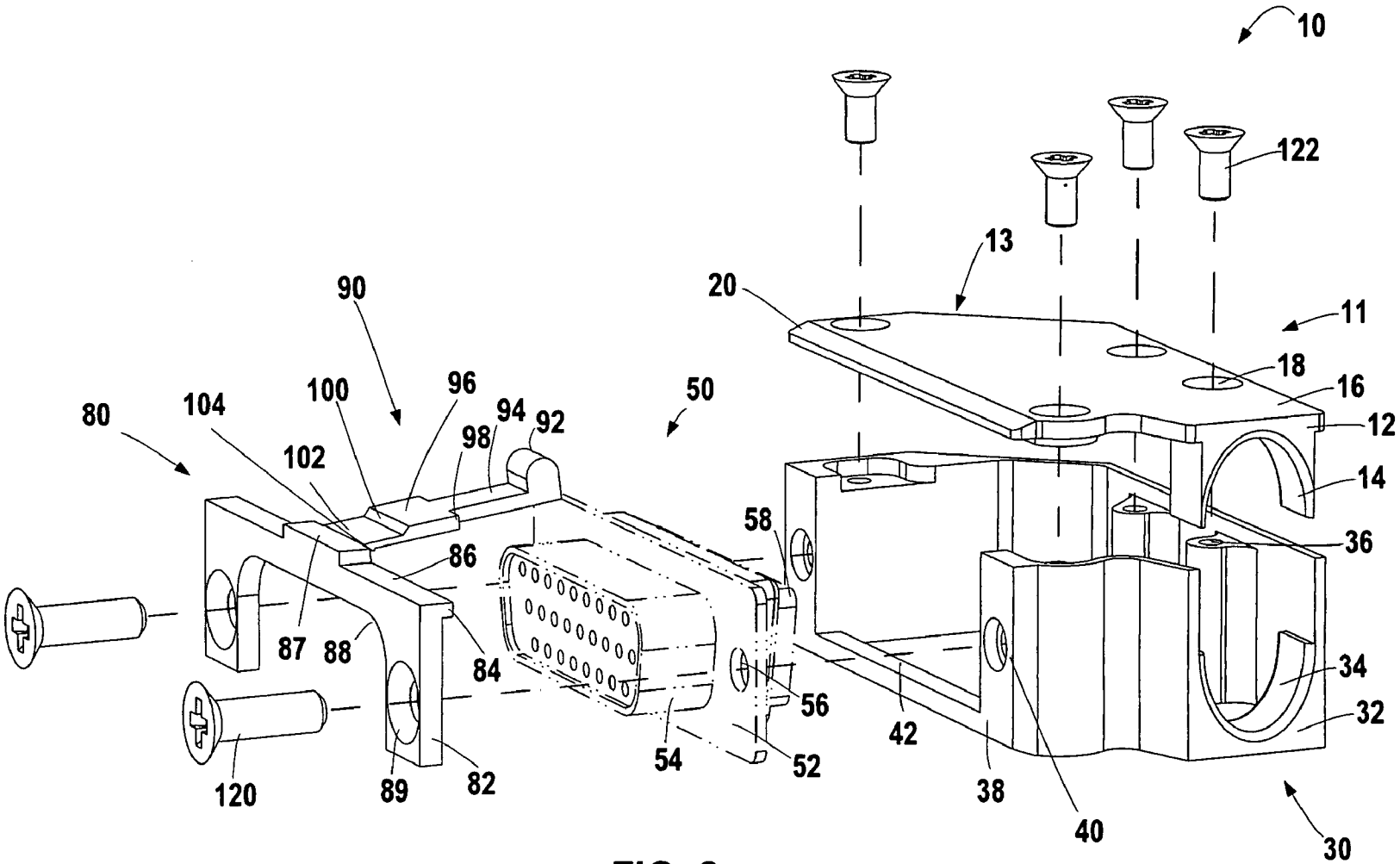
FIG. 2 is an exploded isometric view of the connector shown in FIG. 1.

Referring to FIGS. 2 and 3, the latch 80 is designed to be placed on the front of the connector section 50. It comprises two mounting holes 89 in respective legs 82 of the latch 80 that align with the connector flange mounting holes 56 and the bottom section mounting holes 40 using, e.g., screws 120 that help join the assembly together. The connector latch 80 is preferably formed of a resilient plastic material, although other resilient and semi-resilient materials may be used as well, including metal. In a preferred embodiment, the connector latch 80 is formed of injection molding polycarbonate with fiber reinforcement—this provides a cost effective process and a device with enough strength to sustain repeated plug-unplug cycles.

Referring to FIGS. 2 and 3, the latch 80, in addition to the mounting portions 82-89, further comprises a latch tab 90. The latch tab 90 cooperates with the catch 200 (FIGS. 4A-D) in order to secure the connector 10 when it is plugged in. Advantageously, the tab 90 is readily accessible and easily operable to secure the connector plug 10 when it is plugged in.

The tab comprises a front fastener 102 via which the tab 90 connects the tab 90 with the front part of the latch 80. The tab 90 further comprises an angled surface 100 adjacent to the front fastener 102, and a tab stop 96 on an opposite side. The tab stop 96 comprises a stop edge 98, the function of which is described below. Next is a tab neck 94 that connects a release protrusion 92 to the remaining portion of the tab 90. In a preferred embodiment, the tab 90 is angled θ with respect to a plane defining a top portion surface 86 by about 7°, although this angle could easily be adjusted. The width of the tab stop 96 and the flat portion 102, in a preferred embodiment, is 0.34", and the width of the neck 94 and release protrusion 92 is 0.27". The tab 90 is designed to pivot about the point at which it joins with the front portion of the latch 80, although the pivot angle is generally small and approximately correlating with its angle with respect to the top portion surface plane. When activated by a user, the tab 90 is stopped by contacting the top surface 16 of the connector plug 10.

Referring to FIGS. 4A-4D, a catch assembly 200 is shown that is used to mate with the latch 80 in order to form a releasable locking mechanism. The catch assembly 200 comprises two assembly legs 202 that each comprise a mounting hole 204, permitting the catch assembly 200 to be mounted on a device to which the plug 10 will be inserted. The catch assembly 200 comprises a cutout 208, which may be generally U-shaped (for a D-connector) to allow the connector 54 to be inserted into a mating connector (not shown).

The catch assembly also comprises the catch 210 itself, which comprises two sides 212 extending perpendicular to a planar surface of the leg 202 that may be angled as illustrated in FIG. 4A, each having an inner wall 214. A center wall 216 is provided in a middle region of the catch 210 and also may be angled as well. In a preferred embodiment, the center wall and sides are angled at approximately 6°. The catch 210, in an embodiment, may be approximately 0.5" wide, and 0.485" in length.

The catch 210, on a distal end (away from the portion containing the legs 202) comprises a front portion 220 that extends downwardly in a plane parallel to the planar surface of the legs 202. The front portion 220 comprises a notch 222 in its center portion.

The interaction between the latch 80 and the catch assembly 200 can best be illustrated by FIG. 5, in which the two components 80, 200 are shown spaced apart prior to their engagement. Clearly the latch cutout 88 and catch assembly cutout 208 are aligned to permit the connector 54 to extend through them.

As the latch leg 82 and the catch assembly leg 202 are brought closer together, at some point a bottom surface of the catch front portion 220 contacts a top surface of the latch tab stop 96, due to the angle of the tab 90. The tab 90 is wider than the notch at the tab stop 96 portion, and thus, as the respective legs 82, 202 are brought closer together, the tab 90 angle becomes less while the resilient force exerted by the tab 90 on the front portion 220 surface becomes greater.

However, when the legs are sufficiently close together the tab stop region 96 completely passes the front portion 220 of the catch 210, thereby causing a top surface of tab neck 94 to engage the front portion 220. However, the tab neck 94 is narrower than the notch 222, thereby causing the angle of the tab 90 to relatively abruptly change, while releasing some of its energy.

Once the latch 80 and catch 200 are in this positional relationship to one another, and the tab 90 has increased its angle so that the neck 94 is within the notch 222, a tab stop edge 98 is in an interference fit with an inner edge of the front portion 220, thereby preventing movement that would separate the latch 80 and the catch 200. This therefore holds the connector 54 securely in place.

When the connector is plugged in, outer edges of a latch top protrusion 87 contact catch side inner walls 214 to ensure a solid fit. Furthermore, the catch center wall 216 serves as a stiffening web for the catch assembly 200.

In order to release the connector latch 80 and catch assembly 200, a user simply presses on the tab release protrusion 92, which reduces the angle of the tab 90 sufficiently so that the tab neck 94 no longer remains within the notch 222. In this configuration, there is no longer an interference fit between the tab stop edge 98 and the inner edge of the front portion 220, thereby permitting the latch 80 and catch assembly 200 portions to be easily separated from one another and the connector portion 54 to be removed from its mating connector portion.

Figure 6:
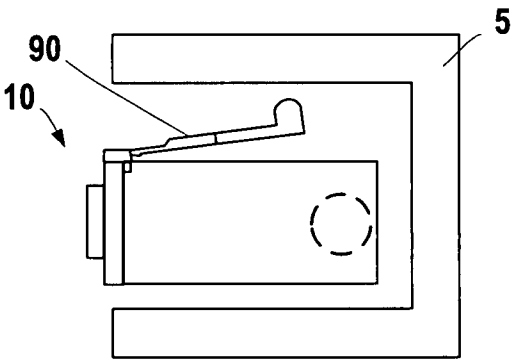
FIG. 6 is a side view illustrating the low-profile D-subshell connector positioned within a limited-space channel.

FIG. 6 illustrates an exemplary use of the connector plug 10 that is located within a limited-space channel 5. An exemplary embodiment might be a connector plug 10 used to attach to a flat-panel display of an aircraft that is surrounded by such a limited-space channel 5. As can be seen, the connector latch tab 90 may easily be depressed in order to disengage the connector, provided that access from a side region of the channel 5 is available.

Thus, according to various embodiments of the present invention, an easy mechanism is provided for securing a D-subshell connector when space is limited.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of components configured to perform the specified functions. The particular implementations shown and described herein are illustrative examples of the invention and are not intended to otherwise limit the scope of the invention in any way. For the sake of brevity, conventional aspects of the mechanism (and components of the individual operating components of the mechanism) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical".

The use of the terms "a" and "an" and "the" and similar referents in the context of describing the invention (especially in the context of the following claims) are to be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein. Finally, the steps of all methods described herein can be performed in any suitable order unless otherwise indicated herein or otherwise clearly contradicted by context.

The word mechanism is intended to be used generally and is not limited solely to mechanical embodiments. Numerous modifications and adaptations will be readily apparent to those skilled in this art without departing from the spirit and scope of the present invention.

TABLE OF REFERENCE CHARACTERS

10-199 connector plug assembly
11-49 backshell assembly
50-79 connector assembly
80-119 connector latch assembly
90-109 connector latch tab assembly
200-249 catch assembly
5 channel
10 connector plug
11 backshell
12 backshell side of top section
13 backshell top section
14 backshell top section wire hole portion
16 backshell top section top surface
18 backshell top section fastening hole
20 backshell top section top surface front edge
30 backshell bottom section
32 backshell side of bottom section
34 backshell bottom section wire hole portion
36 backshell bottom section mounting hole for top section
38 backshell front of bottom section
40 backshell bottom section mounting hole for connector section
42 backshell u-shaped reception portion for connector section
50 connector section
52 connector flange
54 connector
56 connector flange mounting hole
58 connector section rear portion
80 connector latch
82 connector latch leg
84 connector latch lip
86 connector latch top portion
87 connector latch top protrusion
88 connector latch cutout
89 connector latch mounting hole
90 connector latch tab
92 connector latch tab release protrusion
94 connector latch tab neck
96 connector latch tab stop
98 connector latch tab stop edge
100 connector latch tab angled surface
102 connector latch tab flat portion
104 connector latch tab lower protrusion
120 connector front fastener
122 connector top fastener
200 catch assembly
202 catch assembly leg
204 catch assembly mounting hole
208 catch assembly cutout
210 catch
212 catch side
214 catch side inner wall
216 catch center wall
218 catch center wall lower edge
220 catch front portion
222 catch front portion notch

What is claimed is:

1. A D-subshell connector system, comprising:
a connector plug, comprising:
a connector;
a backshell that houses a portion of the connector and is affixed to the connector; and
a latch that is formed as a separate piece and is affixed to the connector and backshell, the latch comprising:
an angled tab that is resiliently pivotally mounted to a front portion of the latch, the tab comprising a wide region adjacent to the pivot, a narrow region on a side of the wide region opposite the pivot, and a release protrusion extending perpendicular from a top surface of the tab at a distal end of the tab; and
a cutout through which the connector extends;
the connector system further comprising:
a catch assembly, comprising:
a body portion having a mounting surface; and
a catch extending in a generally perpendicular direction from the mounting surface, the catch comprising a front portion having a notch therein;
wherein:
a part of the catch front portion serves to engage the wide region of the tab, thereby forcing the tab to pivot when the connector is partially inserted; and
the narrow region of the tab resides in the catch notch when the connector is fully inserted.

2. The connector system according to claim 1, wherein the angle subtended by the tab when it is not constrained is approximately 7° from a top surface of the latch.

3. The connector system according to claim 1, wherein the catch assembly further comprises a center wall extending downward from a center region of the catch that serves to engage a top surface region of the tab.

4. The connector system according to claim 1, wherein the latch further comprises a top protrusion extending from a top surface of the latch and having side walls that engage side walls of the catch.

5. The connector system according to claim 1, wherein the backshell comprises a cable hole that is provided at a 90° angle from a front face of the connector.

6. The connector system according to claim 1, wherein the catch cutout defines legs that are used to affix the catch assembly to a rigid external surface.

7. The connector system according to claim 1, wherein the latch comprises a cutout through which the connector extends.

8. The connector system according to claim 1, wherein the latch cutout defines legs that are used to affix the latch to the connector.

* * * * *